US009260261B2

(12) United States Patent
Adams, Jr. et al.

(10) Patent No.: US 9,260,261 B2
(45) Date of Patent: Feb. 16, 2016

(54) AUDIO DETECTION OF MEDIUM JAM

(71) Applicant: KODAK ALARIS INC., Rochester, NY (US)

(72) Inventors: James E. Adams, Jr., Rochester, NY (US); Bruce A. Link, Rochester, NY (US)

(73) Assignee: KODAK ALARIS INC., Rochester, NY (US)

( * ) Notice: Subject to any disclaimer, the term of this patent is extended or adjusted under 35 U.S.C. 154(b) by 231 days.

(21) Appl. No.: 13/786,502

(22) Filed: Mar. 6, 2013

(65) Prior Publication Data

US 2014/0251016 A1 Sep. 11, 2014

(51) Int. Cl.
*B65H 7/06* (2006.01)
*B65H 43/04* (2006.01)

(52) U.S. Cl.
CPC . *B65H 7/06* (2013.01); *B65H 43/04* (2013.01)

(58) Field of Classification Search
CPC ..... G01M 99/00; G01M 99/005; B65H 43/04
USPC ..... 73/646
See application file for complete search history.

(56) References Cited

U.S. PATENT DOCUMENTS 4,463,607 A 8/1984 Hilton
5,393,043 A 2/1995 Nitta
6,076,821 A 6/2000 Embry et al.
7,484,731 B2 * 2/2009 Gutierrez-Vazquez et al. ..... 271/258.04
8,833,763 B2 * 9/2014 Morikawa et al. ..... 271/263
8,857,815 B2 * 10/2014 Hongo et al. ..... 271/258.01
2001/0042956 A1 11/2001 Minoru et al.
2007/0006654 A1 1/2007 Pradel
2012/0235929 A1 * 9/2012 Hongo et al. ..... 345/173
2014/0077448 A1 * 3/2014 Umi et al. ..... 271/264
2014/0360275 A1 * 12/2014 Link et al. ..... 73/646

FOREIGN PATENT DOCUMENTS

JP 60112547 6/1985
JP 2009249046 10/2009

OTHER PUBLICATIONS

International Preliminary Report on Patentability issued Sep. 8, 2015 in PCT/US2014/020639.
Written Opinion of the International Searching Authority mailed Jun. 9, 2014 in PCT/US2014/020639.

* cited by examiner

*Primary Examiner* — J M Saint Surin
(74) *Attorney, Agent, or Firm* — Hogan Lovells US LLP

(57) ABSTRACT

A method of indicating a medium jam along a medium transport path comprising one or more rollers for use in conveying the medium along the medium transport path; a microphone for detecting the sound of the medium being conveyed and producing a signal representing the sound; a processor for producing sound values from the signal and computing a moving window sum responsive to the sound values; computing a high amplitude count responsive to the sound values; and computing a post roller sum responsive to the sound values; and indicating the medium jam responsive to the moving window sum, high amplitude count, or post roller sum.

16 Claims, 6 Drawing Sheets

AUDIO DETECTION OF MEDIUM JAM

CROSS-REFERENCE TO RELATED APPLICATION

Reference is made to commonly assigned, co-pending U.S. patent application Ser. No. 13/312,601 filed Dec. 16, 2011, entitled: "Sound-Based Damage Detection", by Syracuse et al., the disclosure of which is incorporated herein.

FIELD OF THE INVENTION

This invention pertains to the field of indicating medium jams in a medium transport system and more particularly to a method for detecting and processing sound values in order to indicate a medium jam.

BACKGROUND OF THE INVENTION

It is well known to those skilled in the art that the sound a sheet of paper makes as it moves along a paper transport path can be used to diagnose the condition of the paper. Quiet or uniform sounds can indicate a normal or problem-free passage of the paper along the paper transport path. Loud or non-uniform sounds can indicate a disruption in the passage of the sheet of paper such as a stoppage due to jamming or tearing or other physical damage of the paper. In commonly assigned U.S. Pat. No. 4,463,607 to Hilton et al., entitled "Apparatus for Detecting the Condition of a Sheet," a paper transport cylinder with a specialized profile is used to enhance the diagnostic qualities of the paper transport noise in order to detect paper wear. The problem with this approach is that the specialized paper transport cylinder is designed to induce stresses into the paper that would interfere with smooth paper transport at high transport speeds. Commonly assigned U.S. Pat. 5,393,043 to Nitta, entitled "Image Forming Apparatus with Automatic Paper Supply Mechanism," describes using optical or mechanical sensors in order to detect the times of the passage of a sheet of paper at various locations along the paper transport path. If the paper does not arrive at a given location at a given amount of time after the start of transport, a paper jam is inferred. The problem with this approach is that optical and mechanical sensors are highly localized in physical detection range, requiring the use of several such sensors situated along the paper transport path. Commonly assigned U.S. Patent Application Publication No. 2012/0235929 to Hongo et al, entitled "Paper Feeding Device, Image Scanning Device, Paper Feeding Method and Computer Readable Medium," describes placing a microphone near the beginning of a paper feed path in order to detect the sound of a paper jam in progress. The signal from the microphone is processed by counting the number of sound samples above a given threshold within a sampling window of a given width. If the count is sufficiently large a paper jam is signaled. The problem with this approach is the loss of localized information about the paper as it moves along the transport path as provided by the previously discussed prior art methods.

There remains a need for a fast and robust technique to indicate paper jams along a paper transport path that uses a single paper sensor and processes the signals from the paper sensor simply, and in a way that incorporates the location of the paper along the paper transport path.

SUMMARY OF THE INVENTION

The present invention represents a method of indicating a medium jam along a medium transport path comprising:

one or more rollers for use in conveying the medium along the medium transport path;

a microphone for detecting the sound of the medium being conveyed and producing a signal representing the sound;

a processor for producing sound values from the signal, and:

computing a moving window sum responsive to the sound values;

computing a high amplitude count responsive to the sound values; and computing a post roller sum responsive to the sound values; and indicating the medium jam responsive to the moving window sum, high amplitude count, or post roller sum.

The present invention has the advantage that a microphone can detect the sound of a medium jamming over a larger physical area than optical or mechanic methods which are localized in nature. As a result, one microphone can replace the need for several optical or mechanic sensors.

The present invention has the additional advantage that it processes sound values over the entire medium transport path and at specific locations along the medium transport path thereby improving medium jam detection accuracy and reliability over many prior art methods.

The present invention has the additional advantage that the sound value processing is simple as it comprises computing sums of the sound values produced from the microphone signals. More computationally intensive methods such as transformations into frequency space or signal processing methods such a median filtering are avoided, resulting in sound value processing that requires substantially less computation resources and processing time than many prior art methods.

It is to be understood that the attached drawings are for purposes of illustrating the concepts of the invention and may not be to scale.

DETAILED DESCRIPTION OF THE INVENTION

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, together with hardware and software for producing and otherwise processing the signals involved therewith, not specifically shown or described herein can be selected from such systems, algorithms, components, and elements known in the art. Given the system as described according to the invention in the following, software not specifically shown, suggested, or described herein that is useful for implementation of the invention is conventional and within the ordinary skill in such arts.

Figure 1:
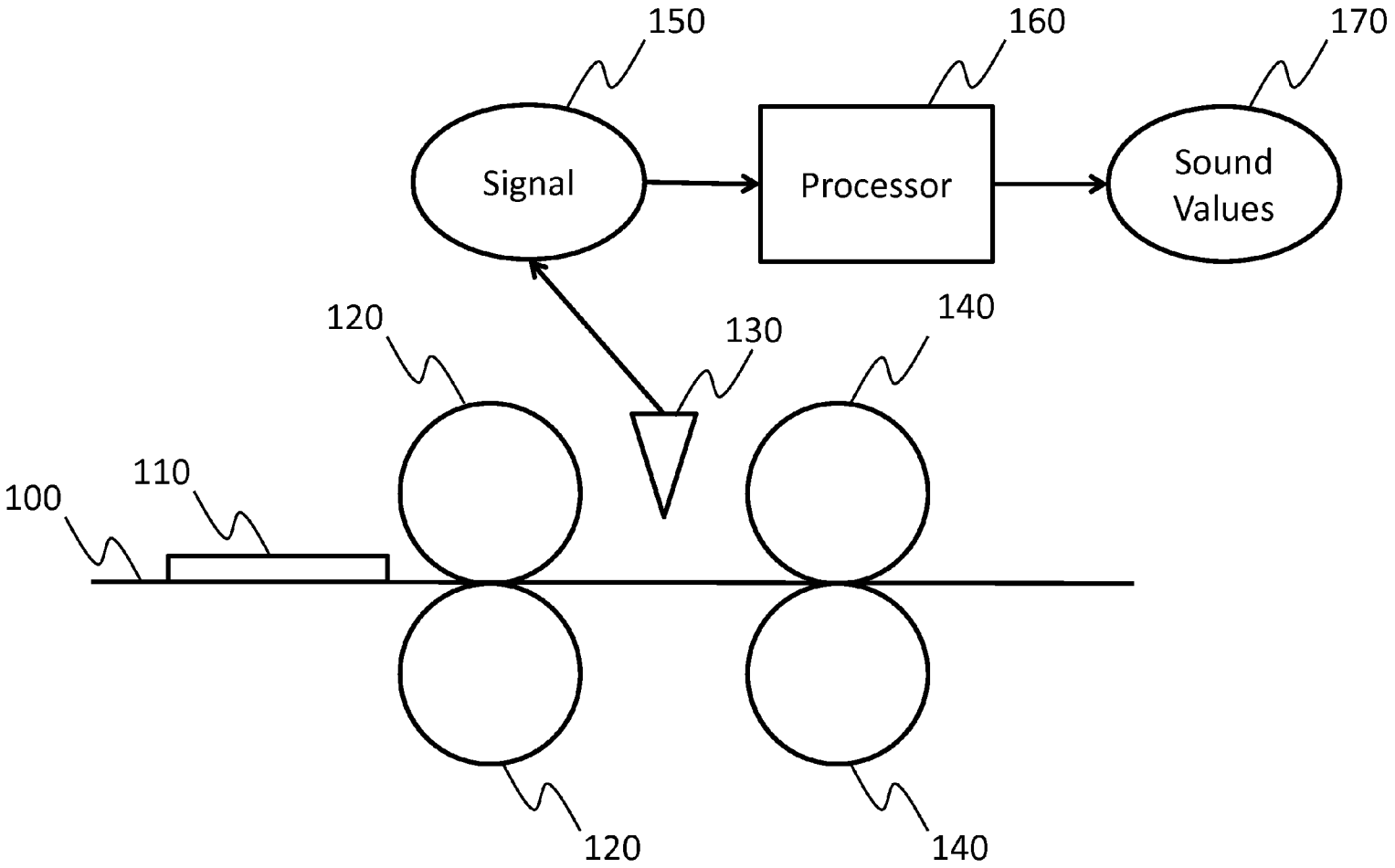
FIG. 1 is a high-level diagram showing the components of a medium transport system according to an embodiment of the present invention.

FIG. 1 is a block diagram of a medium transport system for a preferred embodiment of the present invention. A medium 110 is moved along a medium transport path 100 by a set of rollers collectively referred to as a first roller 120 and a set of rollers collectively referred to as a second roller 140. Examples of the medium 110 are paper, photographic film, and magnetic recording media. Other examples of the medium 110 will be evident to those skilled in the art. A microphone 130 detects the sound of the medium 110 being conveyed along the medium transport path 100 and produces a signal 150 representing the sound. Examples of the microphone 130 are audio microphones, electrostatic sensors, and piezoelectric sensors. Other examples of the microphone 130 will be evident to those skilled in the art. A processor 160 produces sound values 170 from the signal 150.

Figure 2:
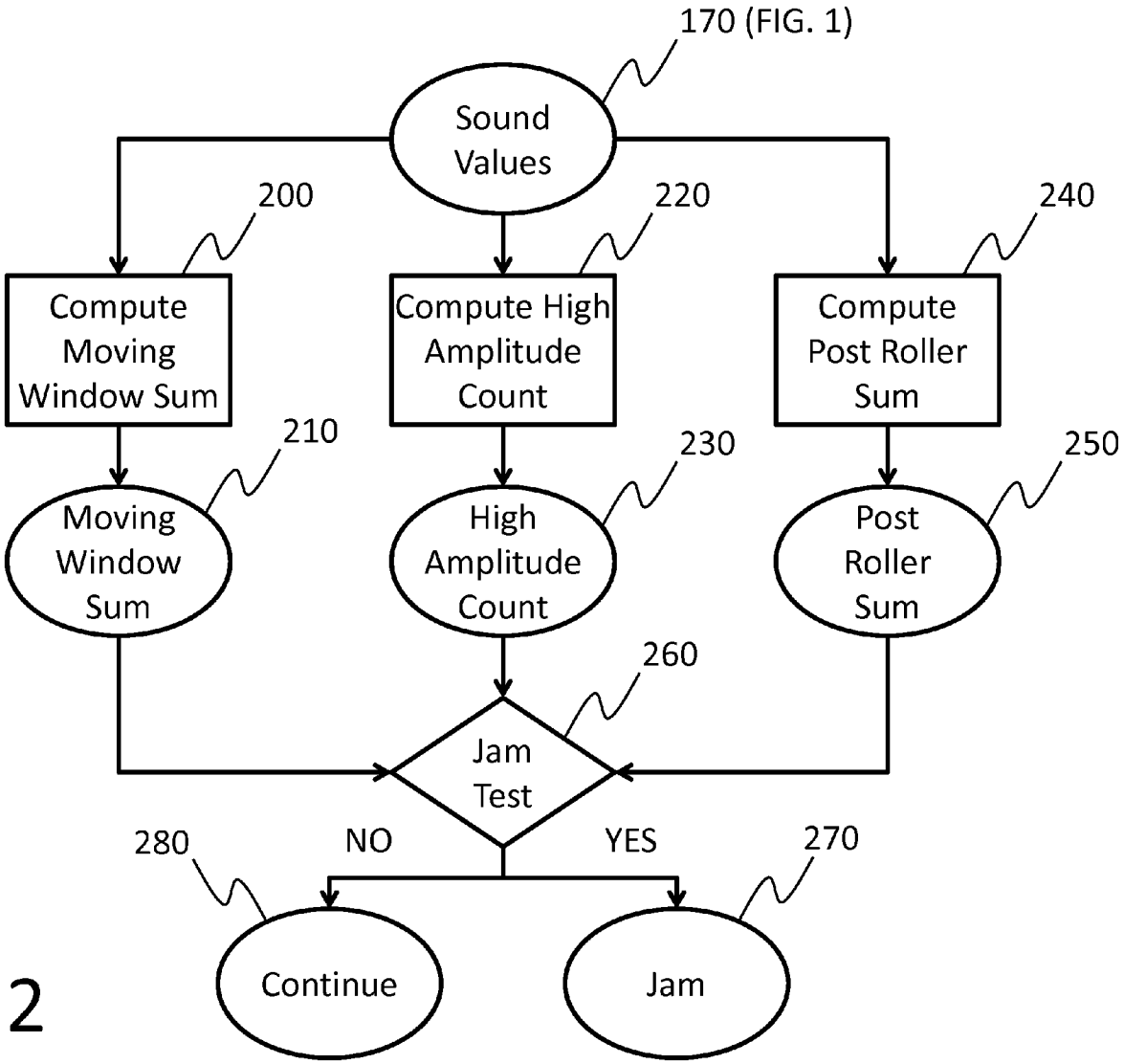
FIG. 2 is a block diagram illustrating a process for indicating a medium jam according to an embodiment of present invention.

FIG. 2 is a flowchart of a signal processing portion of the preferred embodiment of the present invention. A compute moving window sum block 200 produces a moving window sum 210 from the sound values 170 (FIG. 1). A compute high amplitude count block 220 produces a high amplitude count 230 from the sound values 170 (FIG. 1). A compute post roller sum block 240 produces a post roller sum 250 from the sound values 170 (FIG. 1). A jam test block 260 tests the moving window sum 210, the high amplitude count 230, and the post roller sum 250 and produces a YES result and indicates a jam 270 if a medium jam is detected or a NO result and the medium transport system continues operation 280 if a medium jam is not detected. Examples of a medium jam are stoppages of medium movement along the medium transport path 100 (FIG. 1), multiple sheets of medium 110 (FIG. 1) being simultaneously fed into the medium transport path 100 (FIG. 1) designed to convey only single sheets of medium 110 (FIG. 1) at one time, and wrinkling, tearing, or other physical damage to the medium 110 (FIG. 1). Other examples of medium jams will be evident to those skilled in the art.

Figure 3:
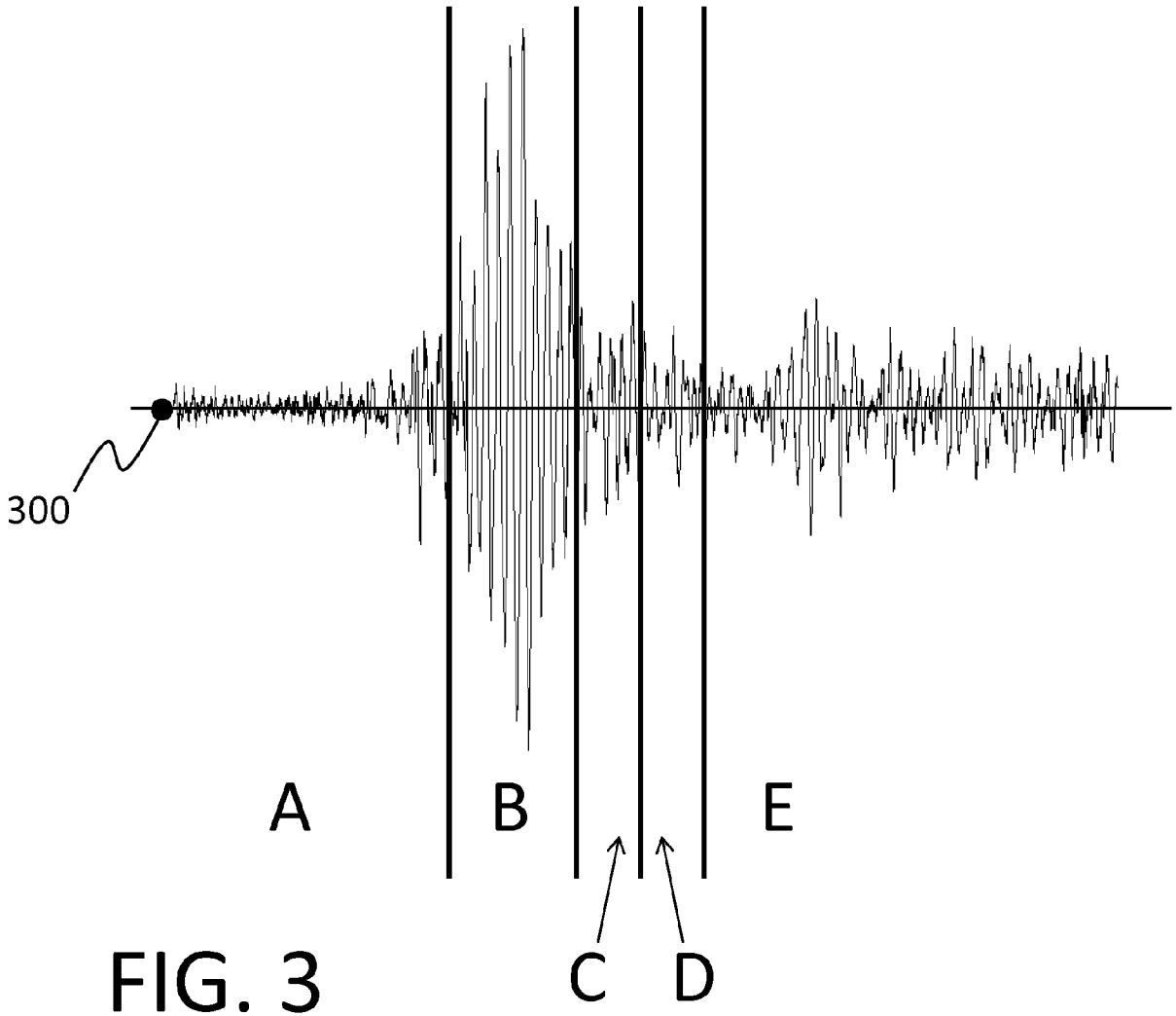
FIG. 3 is an example of the sound values in FIG. 1.

FIG. 3 is an example of a set of sound values 170 (FIG. 1) produces by a normal passage of the medium 110 (FIG. 1) along the medium transport path 100 (FIG. 1). Detection of the sound of the medium 110 (FIG. 1) by the microphone 130 (FIG. 1) begin at a signal start 300 in FIG. 3. Region A in FIG. 3 corresponds to the medium 110 (FIG. 1) passing from the first roller 120 (FIG. 1) to the second roller 140 (FIG. 1). Region B in FIG. 3 corresponds to the medium 110 (FIG. 1) in the vicinity of the second roller 140 (FIG. 1). Region C in FIG. 3 corresponds to the medium 110 (FIG. 1) after it passes the second roller 140 (FIG. 1). Region D in FIG. 3 corresponds to the medium 110 (FIG. 1) after it passes Region C. Region E in FIG. 3 corresponds to the medium 110 (FIG. 1) after it passes Region D.

In FIG. 2 the compute moving window sum block 200 computes a sum of the most recent $N_1$ sound values 170 (FIG. 1) where $N_1$ is typically a thousand. The moving sum calculation begins at the signal start 300 (FIG. 3) and continues until a medium jam is detected or the end of the sound values 170 (FIG. 1) has been reached. The compute high amplitude count block 220 counts the number of sound values 170 (FIG. 1) greater than a high amplitude threshold where the high amplitude threshold is set to be higher than a major of the sound values 170 (FIG. 1) produced by a normal passage of the medium 110 (FIG. 1) along the medium transport path 100 (FIG. 1). The high amplitude count begins at the signal start 300 (FIG. 3) and continues until a medium jam is detected or the end of the sound values 170 (FIG. 1) has been reached. The compute post roller sum block 240 computes at least one sum of sound values 170 (FIG. 1) corresponding to Regions C, D, and E in FIG. 3. In the preferred embodiment of the present invention the compute post roller sum block 240 computes three sums of sound values 170 (FIG. 1). The compute post roller sum block 240 computes a first post roller sum by computing a sum of the sound values 170 (FIG. 1) corresponding to Region C in FIG. 3. Region C in FIG. 3 typically includes 500 sound values 170 (FIG. 1). The compute post roller sum block 240 computes a second post roller sum by computing a sum of the sound values 170 (FIG. 1) corresponding to Region D in FIG. 3. Region D in FIG. 3 typically includes 500 sound values 170 (FIG. 1). The compute post roller sum block 240 computes a third post roller sum by computing a moving sum of the most recent $N_2$ sound values 170 (FIG. 1) within Regions C, D, and E in FIG. 3 where $N_2$ is typically 500.

Figure 4:
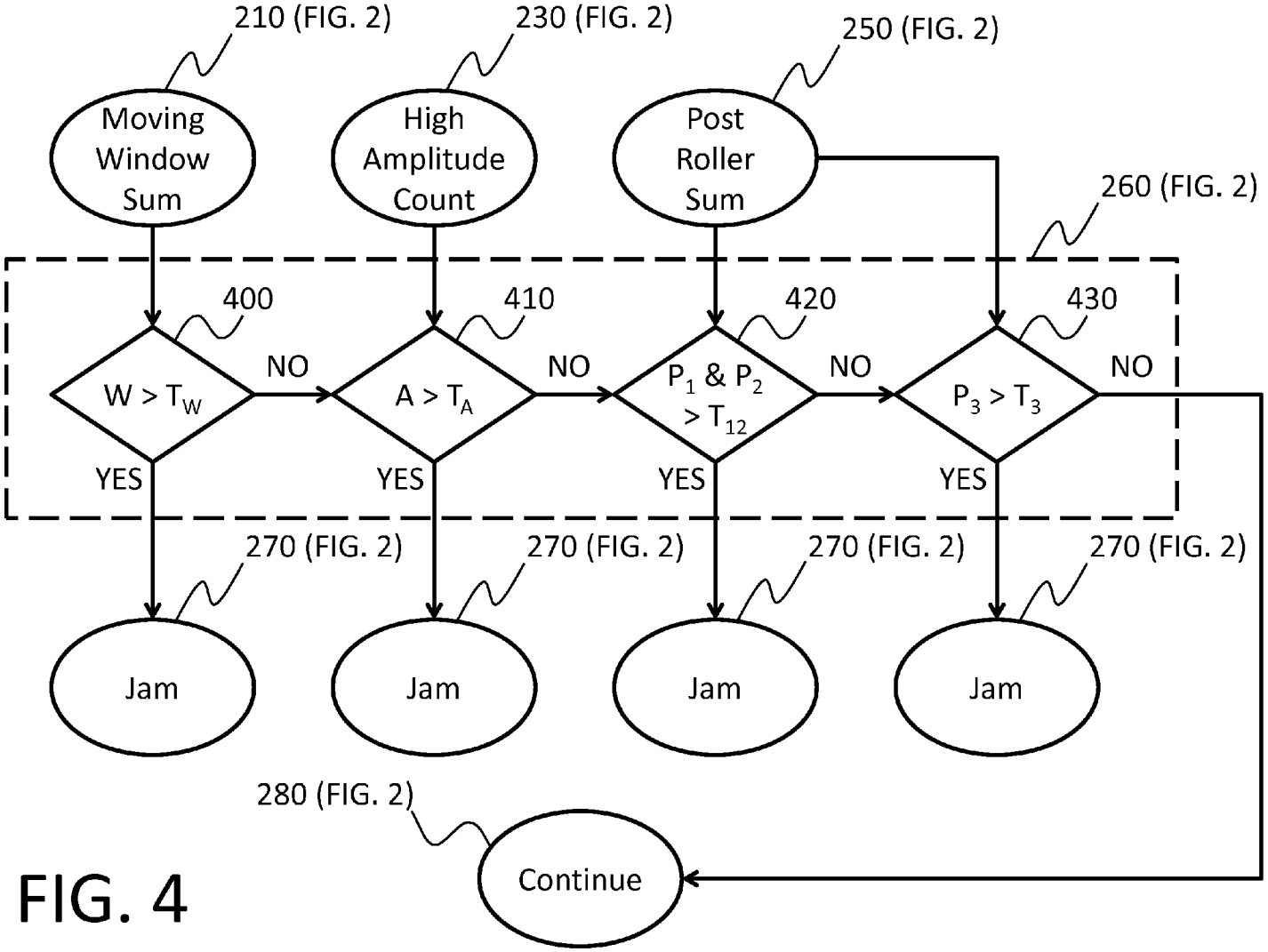
FIG. 4 is a block diagram showing additional details for the jam test block in FIG. 3.

FIG. 4 is a detailed diagram of the jam test block 260 (FIG. 2). Block 400 compares the moving window sum, W, 210 (FIG. 2) to a moving window sum threshold, $T_W$. If the moving window sum, W, 210 (FIG. 2) is greater than the moving window sum threshold, $T_W$, a jam 270 (FIG. 2) is indicated. If the moving window sum, W, 210 (FIG. 2) is not greater than the moving window sum threshold, $T_W$, then block 410 compares the high amplitude count, A, 230 (FIG. 2) to a high amplitude count threshold, $T_A$. If the high amplitude count, A, 230 (FIG. 2) is greater than the high amplitude count threshold, $T_A$, a jam 270 (FIG. 2) is indicated. If the high amplitude count, A, 230 (FIG. 2) is not greater than the high amplitude count threshold, $T_A$, then block 420 compares the first post roller sum, $P_1$, of the post roller sum 250 (FIG. 2) and the second post roller sum, $P_2$, of the post roller sum 250 (FIG. 2) to a first post roller sum threshold, $T_{12}$. If the first post roller sum, $P_1$, of the post roller sum 250 (FIG. 2) and the second post roller sum, $P_2$, of the post roller sum 250 (FIG. 2) are greater than the first post roller sum threshold, $T_{12}$, a jam 270 (FIG. 2) is indicated. If the first post roller sum, $P_1$, of the post roller sum 250 (FIG. 2) or the second post roller sum, $P_2$, of the post roller sum 250 (FIG. 2) is not greater than the first post roller sum threshold, $T_{12}$, then block 430 compares the third post roller sum, $P_3$, of the post roller sum 250 (FIG. 2) to a second post roller sum threshold, $T_3$. If the third post roller sum, $P_3$, of the post roller sum 250 (FIG. 2) is greater than the second post roller sum threshold, $T_3$, a jam 270 (FIG. 2) is indicated. If the third post roller sum, $P_3$, of the post roller sum 250 (FIG. 2) is not greater than the second post roller sum threshold, $T_3$, then the medium transport system continues operation 280 (FIG. 2).

Figure 5:
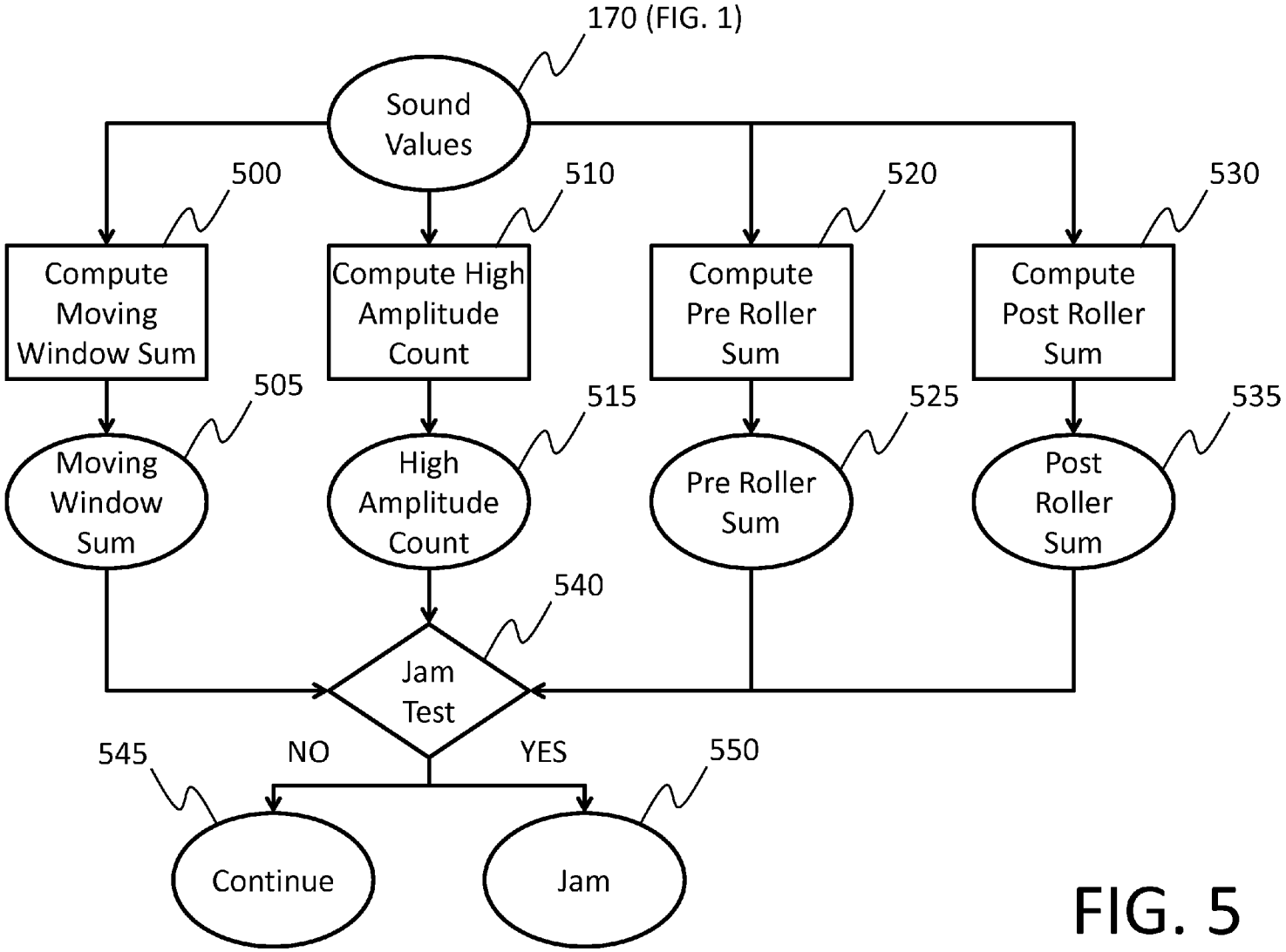
FIG. 5 is a block diagram illustrating a process for indicating a medium jam according to an alternate embodiment of present invention.

FIG. 5 is a flowchart of a signal processing portion of an alternate embodiment of the present invention. A compute moving window sum block 500 produces a moving window sum 505 from the sound values 170 (FIG. 1). A compute high amplitude count block 510 produces a high amplitude count 515 from the sound values 170 (FIG. 1). A compute pre roller sum block 520 produces a pre roller sum 525 from the sound values 170 (FIG. 1). A compute post roller sum block 530 produces a post roller sum 535 from the sound values 170 (FIG. 1). A jam test block 540 tests the moving window sum 505, the high amplitude count 515, the pre roller sum 525, and the post roller sum 535 and produces a YES result and indicates a jam 550 if a medium jam is detected or a NO result and the medium transport system continues operation 545 if a medium jam is not detected.

In FIG. 5 the compute moving window sum block 500 is as the previously described compute moving window sum block 200 (FIG. 2). The compute high amplitude count block 220 is as the previously described compute high amplitude count block 220 (FIG. 2). The compute pre roller sum block 520 computes the pre roller sum 525 by computing a moving sum of the most recent $N_3$ sound values 170 (FIG. 1) within Region A in FIG. 3 where $N_3$ is typically 500. The compute post roller sum block 530 is as the previously described compute post roller sum block 240.

Figure 6:
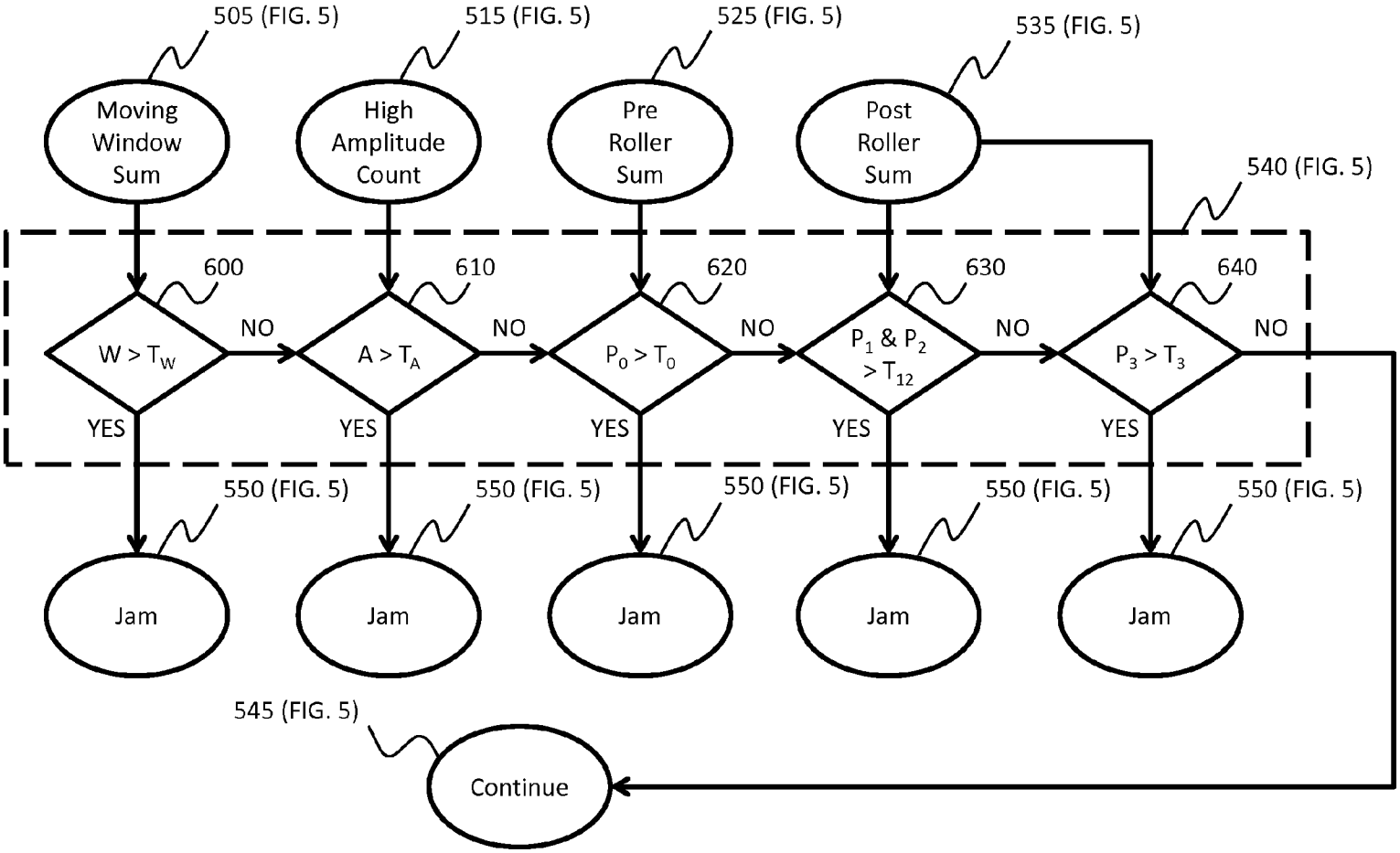
FIG. 6 is a block diagram showing additional details for the jam test block in FIG. 5.

FIG. 6 is a detailed diagram of the jam test block 540 (FIG. 5). Block 600 compares the moving window sum, W, 505 (FIG. 5) to a moving window sum threshold, $T_W$. If the moving window sum, W, 505 (FIG. 5) is greater than the moving window sum threshold, $T_W$, a jam 550 (FIG. 5) is indicated. If the moving window sum, W, 505 (FIG. 5) is not greater than the moving window sum threshold, $T_W$, then block 610 compares the high amplitude count, A, 515 (FIG. 5) to a high amplitude count threshold, $T_A$. If the high amplitude count, A, 515 (FIG. 5) is greater than the high amplitude count threshold, $T_A$, a jam 550 (FIG. 5) is indicated. If the high amplitude count, A, 515 (FIG. 5) is not greater than the high amplitude count threshold, $T_A$, then block 620 compares the pre roller sum 525 (FIG. 5) to a pre roller sum threshold, $T_0$. If the pre roller sum 525 (FIG. 5) is greater than the pre roller sum threshold, $T_0$, a jam 550 (FIG. 5) is indicated. If the pre roller sum 525 (FIG. 5) is not greater than the pre roller sum threshold, $T_0$, then block 630 compares the first post roller sum, $P_1$, of the post roller sum 535 (FIG. 5) and the second post roller sum, $P_2$, of the post roller sum 535 (FIG. 5) to a first post roller sum threshold, $T_{12}$. If the first post roller sum, $P_1$, of the post roller sum 535 (FIG. 5) and the second post roller sum, $P_2$, of the post roller sum 535 (FIG. 5) are greater than the first post roller sum threshold, $T_{12}$, a jam 550 (FIG. 5) is indicated. If the first post roller sum, $P_1$, of the post roller sum 535 (FIG. 5) or the second post roller sum, $P_2$, of the post roller sum 535 (FIG. 5) is not greater than the first post roller sum threshold, $T_{12}$, then block 640 compares the third post roller sum, $P_3$, of the post roller sum 535 (FIG. 5) to a second post roller sum threshold, $T_3$. If the third post roller sum, $P_3$, of the post roller sum 535 (FIG. 5) is greater than the second post roller sum threshold, $T_3$, a jam 550 (FIG. 5) is indicated. If the third post roller sum, $P_3$, of the post roller sum 535 (FIG. 5) is not greater than the second post roller sum threshold, $T_3$, then the medium transport system continues operation 545 (FIG. 5).

A computer program product can include one or more non-transitory, tangible, computer readable storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The invention has been described in detail with particular reference to certain preferred embodiments thereof, but it will be understood that variations and modifications can be effected within the spirit and scope of the invention.

PARTS LIST

100 medium transport path
110 medium
120 first roller
130 microphone
140 second roller
150 signal
160 processor
170 sound values
200 compute moving window sum block
210 moving window sum
220 compute high amplitude count block
230 high amplitude count
240 compute post roller sum block
250 post roller sum
260 jam test block
270 jam
280 continue
300 signal start
400 moving window sum comparison block
410 high amplitude count comparison block
420 first and second post roller sum comparison block
430 third post roller sum comparison block
500 compute moving window sum block
505 moving window sum
510 compute high amplitude count block
515 high amplitude count
520 compute pre roller sum block
525 pre roller sum
Parts List con'td
530 compute post roller sum block
535 post roller sum
540 jam test block
545 continue
550 jam
600 moving window sum comparison block
610 high amplitude count comparison block
620 pre roller sum comparison block
630 first and second post roller sum comparison block
640 third post roller sum comparison block

The invention claimed is:

1. A method of indicating a medium jam along a medium transport path comprising:
(a) one or more rollers for use in conveying the medium along the medium transport path;
(b) a microphone for detecting the sound of the medium being conveyed and producing a signal representing the sound;
(c) a processor for producing sound values from the signal and:
(i) computing a moving window sum responsive to the sound values;
(ii) computing a high amplitude count responsive to the sound values; and
(iii) computing a post roller sum responsive to the sound values; and
(d) indicating the medium jam responsive to the moving window sum, high amplitude count, or post roller sum.

2. The method of claim 1 wherein (c) (i) includes computing the sum of sound values using a given window width.

3. The method of claim 1 wherein (c) (ii) includes computing the sum of sound values that are greater than a high amplitude sound threshold value.

4. The method of claim 1 wherein (c) (iii) includes computing a sum of sound values from a region of the medium transport path after one of the rollers.

5. The method of claim 1 wherein (d) includes indicating a medium jam when the moving window sum is greater than a moving window sum threshold value.

6. The method of claim 1 wherein (d) includes indicating a medium jam when the high amplitude count is greater than a high amplitude count threshold value.

7. The method of claim 1 wherein (d) includes indicating a medium jam when the post roller sum is greater than a post roller sum threshold value.

8. A method of indicating a medium jam along a medium transport path comprising:

(a) one or more rollers for use in conveying the medium along the medium transport path;

(b) a microphone for detecting the sound of the medium being conveyed and producing a signal representing the sound;

(c) a processor for producing sound values from the signal and:

(i) computing a moving window sum responsive to the sound values;

(ii) computing a high amplitude count responsive to the sound values;

(iii) computing a post roller sum responsive to the sound values; and (iv) computing a pre roller sum responsive to the sound values; and (d) indicating the medium jam responsive to the moving window sum, high amplitude count, post roller sum, or pre roller sum.

9. The method of claim 8 wherein (c) (i) includes computing the sum of sound values using a given window width.

10. The method of claim 8 wherein (c) (ii) includes computing the sum of sound values that are greater than a high amplitude sound threshold value.

11. The method of claim 8 wherein (c) (iii) includes computing a sum of sound values from a region of the medium transport path after one of the rollers.

12. The method of claim 8 wherein (c) (iv) includes computing a sum of sound values from a region of the medium transport path before one of the rollers.

13. The method of claim 8 wherein (d) includes indicating a medium jam when the moving window sum is greater than a moving window sum threshold value.

14. The method of claim 8 wherein (d) includes indicating a medium jam when the high amplitude count is greater than a high amplitude count threshold value.

15. The method of claim 8 wherein (d) includes indicating a medium jam when the post roller sum is greater than a post roller sum threshold value.

16. The method of claim 8 wherein (d) includes indicating a medium jam when the pre roller sum is greater than a pre roller sum threshold value.

* * * * *